US005379962A

United States Patent [19]

Albrecht et al.

[11] Patent Number: 5,379,962

[45] Date of Patent: Jan. 10, 1995

[54] HEATED WEB KNIFE

[75] Inventors: James L. Albrecht, Wahpeton, N. Dak.; Leonard M. Volin, Grant Township, County of Washington, Minn.

[73] Assignee: Minnesota Mining and Manufacturing Company, St. Paul, Minn.

[21] Appl. No.: 823,665

[22] Filed: Jan. 21, 1992

[51] Int. Cl.[6] ..... B65H 35/08

[52] U.S. Cl. ..... 242/527.7; 242/526

[58] Field of Search ..... 242/56 R, 527.7, 526; 83/171; 427/179; 118/42, 39

[56] References Cited

U.S. PATENT DOCUMENTS

| | | | |
|---|---|---|---|
| 2,872,126 | 2/1959 | Rockstrom et al. . | |
| 3,161,554 | 12/1964 | Blackford | 83/171 X |
| 3,214,502 | 10/1965 | Schaar | 83/171 X |
| 3,365,992 | 1/1968 | Dreher . | |
| 3,465,627 | 9/1969 | Vigneault | 83/171 |
| 3,567,552 | 3/1971 | Heuff et al. . | |
| 3,794,255 | 2/1974 | Harmon et al. . | |
| 3,869,095 | 3/1975 | Diltz . | |
| 3,910,517 | 10/1975 | Harrison, III . | |
| 4,157,794 | 6/1978 | Brandauer et al. . | |
| 4,422,588 | 12/1983 | Nowisch . | |
| 4,485,979 | 12/1984 | Dropczynski . | |
| 4,487,377 | 12/1984 | Perini . | |
| 4,601,441 | 7/1986 | Oinonen et al. . | |
| 4,635,867 | 1/1987 | Kytönen . | |
| 4,659,029 | 4/1987 | Rodriguez . | |
| 4,678,133 | 7/1987 | Suzski . | |
| 4,700,905 | 10/1987 | Oppelt et al. . | |
| 4,712,459 | 12/1987 | Walkiewicz, Jr. et al. | 83/171 |
| 4,723,724 | 2/1988 | Bradley . | |
| 4,749,139 | 6/1988 | Snygg . | |
| 4,775,110 | 10/1988 | Welp et al. . | |
| 4,842,209 | 6/1989 | Saukkonen . | |
| 4,852,820 | 8/1989 | Looser . | |
| 4,856,725 | 8/1989 | Bradley . | |
| 4,858,843 | 8/1989 | Gierse et al. . | |
| 4,867,387 | 9/1989 | Schönmeier . | |
| 4,886,680 | 12/1989 | Tindall | 427/179 |
| 4,919,351 | 4/1990 | McNeil . | |

FOREIGN PATENT DOCUMENTS

| | | |
|---|---|---|
| 0335028 | 10/1989 | European Pat. Off. . |
| 2019873 | 7/1970 | France . |
| 2336334 | 7/1977 | France . |
| 2387102 | 11/1978 | France . |
| 2499958 | 8/1982 | France . |
| 2923559 | 1/1981 | Germany . |
| 3217628 | 3/1983 | Germany . |
| 1137221 | 12/1968 | United Kingdom . |
| 1164885 | 9/1969 | United Kingdom . |
| 1167767 | 10/1969 | United Kingdom . |
| 1207080 | 9/1970 | United Kingdom . |
| WO87/06218 | 10/1987 | WIPO . |

OTHER PUBLICATIONS

Dienes of Worldwide catalog of Dienes Werke of Germany (M3eFe03.92GD) (No date available).

*Primary Examiner*—Daniel P. Stodola
*Assistant Examiner*—John P. Darling
*Attorney, Agent, or Firm*—Gary L. Griswold; Walter N. Kirn

[57] ABSTRACT

A continuous log roll winder cuts and transfers on the fly without stopping the winding process. The web passes around a rotating drum with the adhesive side out and travels to a wind-up spindle. A knife cuts the web against the surface of the drum. By heating the knife to temperatures above 300° F., the web and adhesive does not stick to the knife; the adhesive does not accumulate on the knife; and the adhesive does not transfer through the cut in the web backing and deposit on the rotating drum.

13 Claims, 1 Drawing Sheet

HEATED WEB KNIFE

TECHNICAL FIELD

The present invention relates to log roll winders. More particularly, the present invention relates to heated knives for log roll winders.

BACKGROUND OF THE INVENTION

Pressure sensitive adhesive (PSA) tape, as well as other adhesive tapes, is often wound in log rolls which are the same length as finished product rolls but have a full web width. These log rolls should be wrinkle and defect free and are lathe slit to the desired product width without rewinding.

Most known log roll winders cut the web while the web is in the air, rather than against a drum. As the knife cuts, it forces the web against a new core. However, as the tail of the web is not supported, the web, particularly thin webs, will not lay down smoothly against the core and wrinkles are produced on the outer wraps. Winders of this type are made by Fuji Tekko.

U.S. Pat. No. 4,775,110 to Welp et al. describes a winding system in which a cutter perforates the web along a line and the web is braked to sever the web. A hot wire can be used as another cutter.

These winders must be stopped while the incoming tape is cut off and started on the core of the next roll. Cutting can not be performed on the fly. In one system attempted by 3M Company, the assignee of this invention, the web is threaded onto a vacuum rotating drum adhesive side out. The web travels with the drum to a wind-up spindle and a cut is made by rotating the knife against the rotating drum while the web is disposed against the surface of the drum. The drum holds the cut ends to prevent wrinkling. This design permits the cut and transfer to be made on the fly without stopping the winding process. This allows the rolls to be wound on line and at machine speeds on a continuous basis.

However, conventional knives having a set range of parameters can not properly cut off adhesive-coated webs against a drum during continuous winding operations without cutting difficulties caused by the adhesive. Three separate and related problems occur. The web and adhesive stick to the knife and wrap on the knife as the knife rotates through the cut point; adhesive accumulates on the knife; and adhesive transfers through the cut in the web backing and is deposited on the rotating drum.

Applying oils, greases, waxes, and lubricants to the knife, as commonly performed with lathe slitters, do not prevent these adhesive accumulation and transfer problems. Varying the knife grinding angles, dimensions, tooth type, and tooth size also did not noticeably prevent these problems. Varying the angle between the knife axis and the drum surface also did not eliminate the adhesion problems. Chilling the knife to temperatures from −50° F. to 40° F. eliminated adhesion problems. However, the adhesive and web contacting the knife became stiff during the contact time and could not be easily cut.

Heated knives are described in a Dienes Corporation catalog. The catalog describes two basic applications, one at a temperature suitable for simple adhesive softening, and one at very high (carbonization) temperatures. For simple adhesive softening, the Dienes score and shear knives are heated to about 158° .F (70° C.). Heating prevents the adhesive from sticking to the knife.

The Dienes catalog deals with longitudinal slitting, rather than transverse cutting of the web. In slitting applications, knives are continuously rolled or dragged against the adhesive coated web. By softening the adhesive next to the knife with heat, the adhesive shear strength adjacent the knife is less than in the adjacent adhesive. This low strength boundary layer of adhesive next to the knife allows the material being slit to continuously wipe most of the adhesive from the knife. However, a thin layer of adhesive still remains on the knife.

Dienes also discloses a very high temperature knife called an "element" which can be heated up to 1382° F. (750° C.). This high temperature carbonizes the coating and backing. Dienes discusses using this element to "separate" the material and "fuse" or seal the strands on the edge of woven material to prevent unraveling, as with typewriter ribbon.

Heated knives also are used to cut plastic against a paper substrate by softening and penetrating the plastic which leaves the paper substrate uncut. Heated razor blades are used to slit PSA film tapes by softening the adhesive during cutting. However, knife temperatures approximate 200° F. High temperature heated wires have been used to cut a web without an adhesive coating by melting or burning through the web. However, rather than cutting these heated wires melt through the web and do not address preventing adhesive related problems.

With adhesive coated webs, there is no known system which heats a cutting knife to temperatures between the softening and carbonization temperatures of the adhesive. Nor is there any disclosure of heating a knife which transversely cuts an adhesive web to prevent the adhesive on the web from sticking to the knife, to prevent the adhesive from accumulating on the knife, and to prevent the adhesive from transferring through the cut in the backing and depositing on the rotating drum when the web is cut against a drum.

SUMMARY OF THE INVENTION

The present invention overcomes these adhesion, accumulation, and transfer problems in continuous log roll winders which cut and transfer on the fly without stopping the winding process by cutting the web with a knife heated to temperatures above that at which the adhesive loses tack, yet below that at which the adhesive carbonizes. For PSA tapes, this temperature would be above 300° F. The web is threaded onto a rotatable drum with the adhesive side out. The web travels with the drum to a wind-up spindle and a cut is made by rotating the knife against the drum while the web is disposed against the surface of the drum. The drum holds the cut ends to prevent wrinkling. By heating the knife to temperatures above 300° F., the web and adhesive does not stick to the knife; the adhesive does not accumulate on the knife; and the adhesive does not transfer through the cut in the web backing and deposit on the drum.

DETAILED DESCRIPTION OF PREFERRED EMBODIMENTS

Figure 1:
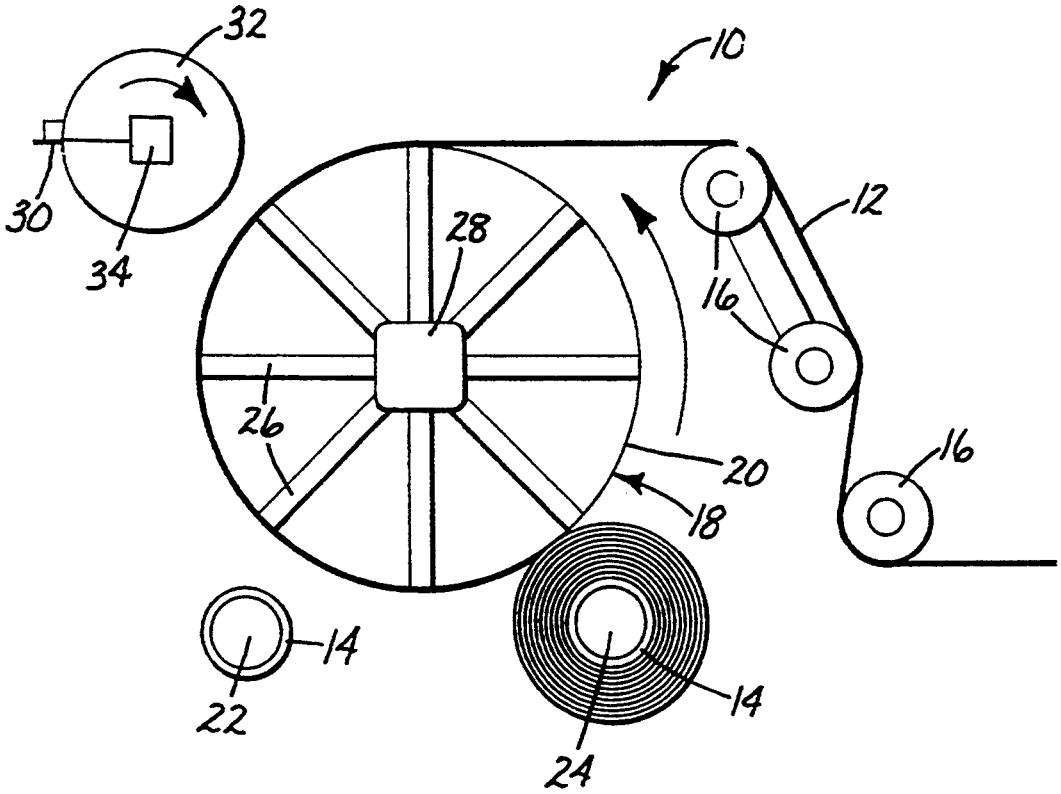
FIG. 1 is a schematic view of a winding system using a heated knife cutter of the present invention.

The winding system having a heated knife cutter of the present invention is used to wind web on cores after the web is processed. The winding system 10 permits transferring the web 12 between cores 14 on the fly. One winding system includes rollers 16 around which the web winds. The web then travels to a drum 18 which, in the illustrated embodiment is rotated. The drum 18 is located downline of the rollers 16 such that the web 12 travels in intimate contact with a portion of the surface 20 of the drum 18 after passing the rollers 16.

The drum outer surface 20 is covered with urethane rubber or other elastomeric material which firmly supports the web 12 such that a cutting knife will penetrate the web 12 when the knife is pressed against the web 12. The drum surface 20 can be steel as long as the knife travel is precisely controlled to avoid knife damage. Also, the surface 20 can have a narrow groove which would engage the knife such that the edges of the groove would support the web 12 close to the cut while the cut is actually made in the open air space between the edges of the groove. Two wind-up spindles 22, 24 are located adjacent the drum 18 and receive the cores 14 on which the web 12 is alternately wound.

The web 12 can have an adhesive side, such as PSA, which faces outwardly when the web 12 is wrapped around the drum 18. This prevents the web 12 from adhering to the drum surface 20 and permit the web 12 to transfer to the cores 14 by adhesion. Adhesion transfer to the cores 14 with nonadhesive webs can be accomplished by placing adhesive directly on the cores. Adhesive webs 12 permit the tab to be adhered to the web without adhesive on the tab. The drum 18 includes a series of holes 26 on its surface 20 which are connected to a source of vacuum 28 through the drum 18. The vacuum provides a mechanism for maintaining the web 12 in close contact with the drum 18 during winding.

A cutting knife 30 is located upline of both wind-up spindles 22, 24 and cuts the web 12 as the web 12 rotates against the drum 18. The knife 30 is mounted on a rotating wheel 32. A tab (not shown) can be applied on the end of the web 12 as part of the cutting process. The knife 30 cuts the web 12 against the drum 18 which holds the cut ends of the web 12 to prevent wrinkling. Thus, the cut and transfer can be performed on the fly without stopping the winding process such that the rolls can be wound on line and at machine speeds on a continuous basis. A heater 34 heats the knife 30 to improve cutting.

It has been discovered by the inventors that heating the knife 30 to temperatures ranging from 40° F. to 300° F. exacerbates the adhesion problems. As the temperature is raised, the adhesive softens more and the adhesion problem worsens. These results imply that further raising the temperature of the knife 30 would further soften the adhesive and increase adhesion and adhesive transfer problems.

By heating the knife to temperatures above that at which the adhesive loses tack, yet below that at which the adhesive carbonizes, the winder can cut and transfer on the fly without stopping the winding process while overcoming the adhesion, accumulation, and transfer problems. For PSA tapes, this temperature would be above 300° F. By heating the knife to these temperatures, the web and adhesive do not stick to the knife; the adhesive does not accumulate on the knife; and the adhesive does not transfer through the cut in the web backing and deposit on the drum. Additionally, the web backing cuts easier and with less force.

Due to the speed required for transverse cut off, the knife 30 must cut by pressing or stabbing through the adhesive coated web 12. The continuous self-cleaning dragging and wiping action of adjacent adhesive, present with longitudinal slitting, does not exist with transverse cutting. Without it, adhesive softened by heating would coat the knife and be pressed through the product onto the drum, which would require unacceptable cleanup.

It is believed that the heated cutting knife 30 system achieves the desired results because one of the major adhesive components melts while the adhesive contacts the knife. This radically changes the rheology of the adhesive much more than simply softening the adhesive with slightly elevated temperature. Furthermore, the adhesive component which melts can become a lubricant next to the knife.

This cutting system can be used on continuous or noncontinuous-speed drum winders, with slit or unslit webs, and with or without adhesive-coated webs. The heated knife also can be used to cut any type of web in the air and not against a backing. The cutting of nonsticky and nonorganic webs, such as glass cloth is also improved by the heated knife.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention.

We claim:

1. A cutter for cutting a web of material having a backing and an adhesive layer disposed on the backing, the cutter comprising:

(a) means for invasively cutting the web, and (b) means for heating said invasive cutting means to a temperature between (i) the temperature at which the adhesive loses tack, and (ii) the temperature at which the adhesive carbonizes, to prevent adhesive from sticking to said invasive cutting means;

whereby to cut the web, said invasive cutting means penetrates, in order, (i) the adhesive layer and (ii) the backing.

2. The cutter of claim 1, wherein the web includes a layer of adhesive on each side of the backing.

3. The cutter of claim 1, wherein the invasive cutting means is adapted to cut the web while the web is continuously conveyed from a first location to a second location.

4. The cutter of claim 1, wherein the cutter is adapted to cut the web while the web is supported by a cutting surface.

5. The cutter of claim 4, wherein the cutting surface is a rotatable drum having a cylindrical peripheral surface, and wherein the peripheral surface of the drum is rotating at the same velocity as the velocity at which the web is being conveyed.

6. The cutter of claim 1, wherein the temperature in substep (i) is approximately 300° F., and the temperature in substep (ii) is approximately 450° F.

7. A system for handling and cutting a web of material having a backing and an adhesive layer disposed on the backing, comprising:

(a) a rotatable drum having a peripheral surface on which the web is carried with the adhesive layer facing away from the peripheral surface; and (b) a cutter that cuts the web against the drum, comprising, (i) means for invasively cutting the web, and (ii) means for heating said invasive cutting means to a temperature between (A) the temperature at which the adhesive loses tack, and (B) the temperature at which the adhesive carbonizes, to prevent adhesive from sticking to said invasive cutting means;

whereby to cut the web, said invasive cutting means penetrates, in order, (i) the adhesive layer and (ii) the backing with the cutter, while the web is supported by the peripheral surface of the drum.

8. The system of claim 7, wherein the temperature in substep (A) is approximately 300° F., and the temperature in substep (B) is approximately 450° F.

9. The system of claim 7, wherein the web includes a first adhesive layer on a first major surface of the backing, and a second adhesive layer on a second, opposed major surface of the backing.

10. A method of cutting a web of material having a backing and an adhesive layer disposed on the backing, comprising the steps of:

(a) providing a cutter for invasively cutting the web;

(b) supporting the web on a cutting surface:

(c) heating the cutter to a temperature between (i) the temperature at which the adhesive loses tack, and (ii) the temperature at which the adhesive carbonizes, to prevent adhesive from sticking to the cutter; and (d) cutting the web against the cutting surface by penetrating, in order, (i) the adhesive layer and (ii) the backing layer with the cutter.

11. The method of claim 10, wherein step (d) comprises penetrating completely through both the adhesive layer and the backing layer with the cutter.

12. The method of claim 11, wherein the cutter penetrates completely through both the adhesive layer and the backing layer across a width of the web.

13. The method of claim 10, wherein the temperature in substep (i) is approximately 300° F., and the temperature in substep (ii) is approximately 450° F.

* * * * *

UNITED STATES PATENT AND TRADEMARK OFFICE

CERTIFICATE OF CORRECTION

PATENT NO. : 5,379,962

DATED : January 10, 1995

INVENTOR(S) : James L. Albrecht and Leonard M. Volin

It is certified that error appears in the above-identified patent and that said Letters Patent is hereby corrected as shown below:

Col. 6, line 16, after "backing" delete "layer".

Col. 6, line 19, after "backing" delete "layer".

Col. 6, line 22, after "backing" delete "layer".

Signed and Sealed this

Twenty-first Day of November, 1995

Bruce Lehman

*Attest:*

BRUCE LEHMAN

*Attesting Officer*

*Commissioner of Patents and Trademarks*